US007507065B2

(12) United States Patent
Ando et al.

(10) Patent No.: US 7,507,065 B2
(45) Date of Patent: Mar. 24, 2009

(54) FUEL PUMP

(75) Inventors: Kazuya Ando, Obu (JP); Seiji Ii, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 532 days.

(21) Appl. No.: 11/175,675

(22) Filed: Jul. 7, 2005

(65) Prior Publication Data

US 2006/0008344 A1 Jan. 12, 2006

(30) Foreign Application Priority Data

Jul. 9, 2004 (JP) ..... 2004-202838

(51) Int. Cl.
*F04D 29/42* (2006.01)

(52) U.S. Cl. ..... 415/55.2

(58) Field of Classification Search ..... 415/55.1, 415/55.2, 55.3, 55.5, 55.6
See application file for complete search history.

(56) References Cited

U.S. PATENT DOCUMENTS

| | | | | |
|---|---|---|---|---|
| 4,403,910 | A * | 9/1983 | Watanabe et al. | 415/55.4 |
| 5,464,319 | A * | 11/1995 | Liskow | 415/55.1 |
| 5,472,321 | A | 12/1995 | Radermacher | |
| 5,732,888 | A | 3/1998 | Maier et al. | |
| 5,807,068 | A | 9/1998 | Dobler et al. | |
| 5,918,818 | A | 7/1999 | Takeda | |
| 6,152,687 | A | 11/2000 | Wilhelm et al. | |
| 6,210,102 | B1 | 4/2001 | Yu et al. | |
| 6,422,808 | B1 * | 7/2002 | Moss et al. | 415/55.1 |
| 6,443,693 | B1 * | 9/2002 | Eck | 415/55.1 |
| 2001/0026757 | A1 * | 10/2001 | Marx et al. | 415/55.1 |
| 2004/0191054 | A1 | 9/2004 | Honda et al. | |
| 2004/0258515 | A1 | 12/2004 | Honda et al. | |

FOREIGN PATENT DOCUMENTS

| | | |
|---|---|---|
| DE | 19748448 | 5/1999 |
| JP | 02238193 | 9/1990 |
| JP | 2003328891 | 11/2003 |
| JP | 02-238193 | 9/2005 |

* cited by examiner

*Primary Examiner*—Edward Look
*Assistant Examiner*—Aaron R Eastman
(74) *Attorney, Agent, or Firm*—Dennison, Schultz & MacDonald

(57) ABSTRACT

Fuel pump (10) may comprise a casing (18) and a substantially disc-shaped impeller (20) which is rotatably disposed within the casing (18). A first group of concavities (21*a*) may be formed in a lower face of the impeller (20). A second group of concavities (20*a*) may be formed in an upper face of the impeller (20). A first groove (30) may be formed in the inner face of the casing (18) opposite the upper face of the impeller (20). The first groove (30) is formed in a region opposite the first group of concavities (21*a*) and extending from an upstream end to a downstream end. A second groove (24) may be formed in the inner face of the casing opposite the lower face of the impeller (20). The second groove (24) is formed in a region opposite the second group of concavities (20*a*) and extending from an upstream end to a downstream end. Preferably, the depth of the first and second groups of concavities and the depth of the first and second grooves are adjusted such that the flow of fuel flowing through the first group of concavities (21*a*) and the first groove (30) is greater than the flow of fuel flowing through the second group of concavities (20*a*) and the second groove (24).

8 Claims, 7 Drawing Sheets

FUEL PUMP

CROSS REFERENCE

This application claims priority to Japanese Patent application number 2004-202838, filed on Jul. 9, 2004, the contents of which are hereby incorporated by reference as if fully set forth herein.

BACKGROUND OF THE INVENTION

1. Field of the Invention

The present invention relates to a fuel pump for drawing a fuel such as gasoline etc., increasing the pressure thereof, and discharging this pressurized fuel.

2. Description of the Related Art

A known fuel pump generally comprises a substantially disc-shaped impeller and a casing. The impeller is rotatably disposed within the casing. Groups of concavities are formed along the circumference direction of the impeller. The concavities are repeated in the circumferential direction. A first groove is formed in the front surface of the casing in an area directly facing the group of concavities in the upper face of the impeller. The first groove extends continuously in a circumference direction from an upstream end to a downstream end. A second groove is formed in the back surface of the casing in an area directly facing the group of concavities in the lower face of the impeller. The first groove extends continuously in a circumference direction from an upstream end to a downstream end. A suction hole is formed to pass through the casing for communicating the upstream end of the first groove. A discharge hole is formed to pass through the casing for communicating the downstream end of the second groove.

When the impeller rotates, a fuel is sucked into the casing from the suction hole. The sucked fuel flows along the groove and the concavities of the impeller. Swirl flow occurs between the concavities on the front surface of the impeller and the first groove and swirl flow occurs between the concavities on the back surface of the impeller and the second groove because of the effects of centrifugal force caused by the rotation of the impeller. The pressure of the fuel rises as it flows along the grooves. The fuel that has flowed along the grooves and has been pressurized is discharged out of the casing through the discharge hole.

In this type of fuel pump, swirl flow is created between the groove of the casing and the concavities of the impeller. If the flow of this swirl flow could be improved to reduce energy loss, the efficiency of the fuel pump could be increased. In the fuel pump disclosed in Japanese Laid-Open Patent Publication No. 9-511812, partitioning walls which separate the adjacent concavities of the impeller are at an angle with regard to the rotating shaft of the impeller in order to improve the fuel flow.

SUMMARY OF THE INVENTION

With this type of fuel pump, a force (e.g., thrust direction force) is created in the direction that the impeller presses on the casing. For example, fuel is drawn into the first groove formed on the front side of the impeller and fuel is discharged from the second groove formed on the back side of the impeller. Therefore, the fuel on the back side of the impeller, which is the fuel discharge side, has high pressure while the fuel on the front side of the impeller, which is the fuel intake side, has low pressure. Therefore, a force is applied on the impeller in the direction from the back side of the impeller to the front side. When this force acts on the impeller, the impeller is pushed against the casing and the impeller rotational speed is reduced. When the rotational speed of the impeller drops, the pressure of the fuel discharged from the fuel pump will also drop. When the pressure of the discharged fuel drops, the aforementioned pressing action of the impeller on the casing will be reduced, and the pressure of the fuel being discharged from the fuel pump will rise. In this manner, the fuel discharged from the fuel pump will have a pulsing motion and the flow performance of the fuel pump will be reduced. Conventional fuel pumps have improved the fuel flow, but the aforementioned problems have not been resolved.

Accordingly, it is one object of the present teachings to provide a fuel pump which can reduce the variation of the impeller rotational resistance based upon the difference between the fuel pressure on the fuel discharge side and the fuel pressure on the fuel intake side of the impeller, and thereby increasing the flow performance of the fuel pump.

In one aspect of the present teachings, fuel pump may comprise a casing and a substantially disc-shaped impeller rotating within the casing. A first group of concavities may be formed in an upper face of the impeller. A second group of concavities may be formed in a lower face of the impeller. A first groove is formed in the inner face of the casing opposite the upper face of the impeller, the first groove being formed in a region opposite the first group of concavities in the impeller and extending from an upstream end to a downstream end. A second groove is formed in the inner face of the casing opposite the lower face of the impeller, the second groove being formed in a region opposite the second group of concavities in the impeller and extending from an upstream end to a downstream end. A suction hole is formed to pass through the casing for communicating the upstream end of the first groove to the exterior of the casing. A discharge hole is formed to pass through the casing for communicating the downstream end of the second groove to the exterior of the casing. Furthermore, the depth of the first and second groups of concavities and the depth of the first and second grooves are adjusted such that the flow of fuel flowing through the first group of concavities and the first groove is greater than the flow of fuel flowing through the second group of concavities and the second groove.

With this fuel pump, the flow rate of the fuel which revolves along the first groove and the first group of concavities on the upper face of the impeller (i.e., the fuel intake side of impeller) will be higher than the flow rate of fuel which revolves along the second groove and the second group of concavities on the lower face of the impeller (i.e., the fuel discharge side of the impeller). Therefore, the force acting on the impeller from the revolving flow (swirl flow) generated on the fuel intake side of the impeller will be higher than the force acting on the impeller from the revolving flow (swirl flow) generated on the fuel discharge side of the impeller. Thus, the forces acting on the impeller will be canceled by the difference in fuel pressure on the upper and lower sides of the impeller. Therefore, variation in the resistance to rotation of the impeller caused by the difference in the fuel pressure on the upper and lower sides of the impeller can be suppressed and the flow properties of the fuel pump can be improved.

In one embodiment of the present teachings, the depth of the first group of concavities formed on the upper surface of the impeller and the depth of the second group of concavities formed on the lower surface the impeller can be substantially identical. Further, the depth of the first groove is deeper than the depth of the second groove. In this configuration, the flow rate of the fuel flowing on the fuel intake side can be made to be greater than the flow rate of the fuel flowing in the fuel discharge side. Therefore, the difference in the fuel pressures of the upper and lower sides of the impeller can be canceled.

Preferably, the depth of the first groove is within the range of 1.02~1.30 times the depth of the second groove. If the ratio of the depth of the first groove to the depth of the second groove is smaller than 1.02, sufficient effects can not be obtained. Furthermore, if the ratio of the depth of the first groove to the depth of the second groove is greater than 1.30, the force acting on the fuel discharge side of the impeller from the fuel intake side of the impeller will be too large, and the balance will be poor.

In another embodiment of the present teachings, the depth of the first groove and the depth of the second groove can be substantially identical. Further, the depth of the first group of concavities formed on the upper face of the impeller is deeper than the depth of the second group of concavities formed on the lower face of the impeller. In this configuration, the flow rate of fuel flowing on the fuel intake side will be greater than the flow rate of fuel flowing on the fuel discharge side. Therefore, the difference in the fuel pressure on both the upper and lower sides of the impeller can be canceled.

Preferably, the depth of the first group of concavities formed on the upper face of the impeller is preferably within the range of 1.02~1.30 times the depth of the second group of concavities formed on the lower face of the impeller.

These aspects and features may be utilized singularly or, in combination, in order to make improved fuel pump. In addition, other objects, features and advantages of the present teachings will be readily understood after reading the following detailed description together with the accompanying drawings and claims. Of course, the additional features and aspects disclosed herein also may be utilized singularly or, in combination with the above-described aspect and features.

DETAILED DESCRIPTION OF THE INVENTION

Figure 1:
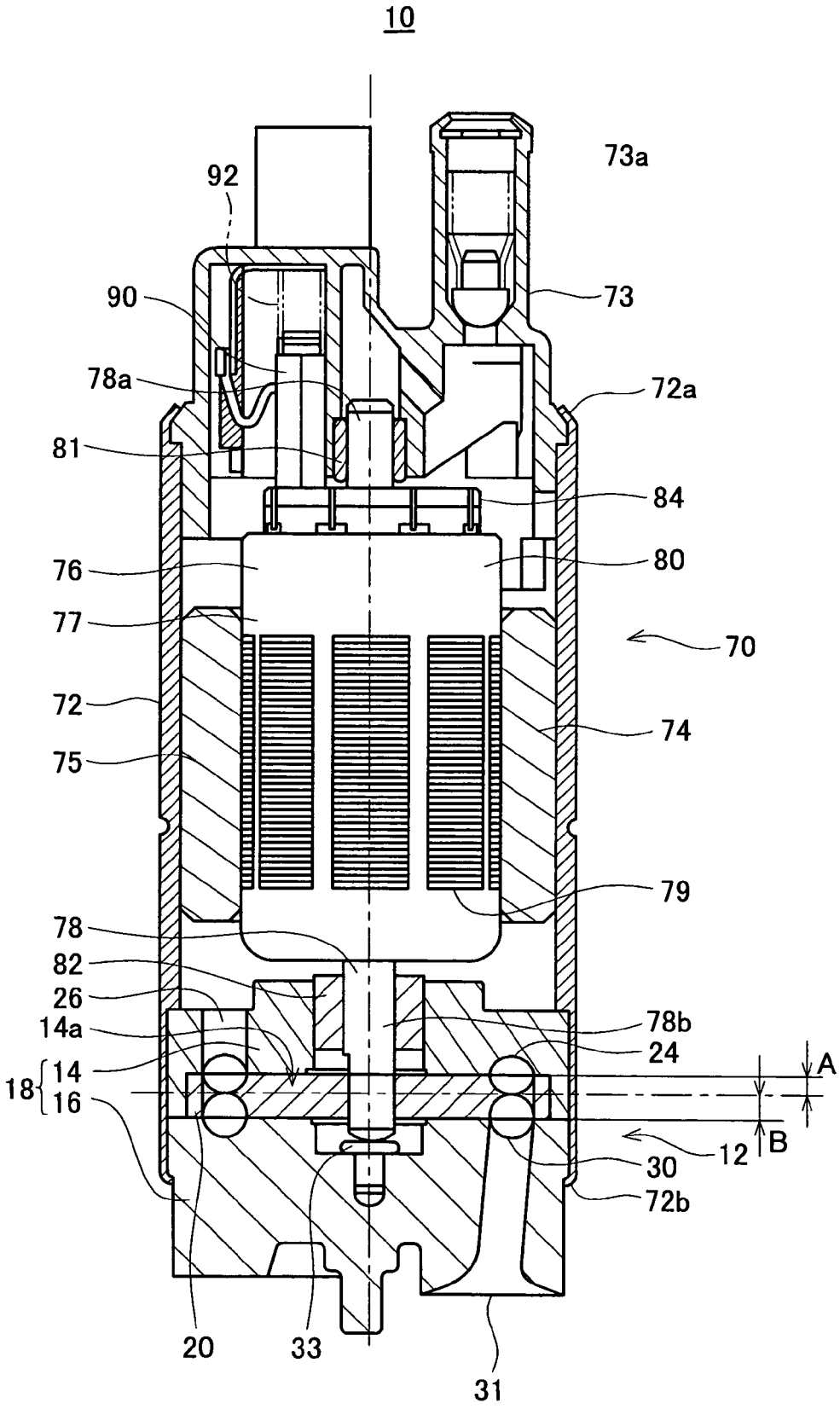
FIG. 1 is a longitudinal sectional view of a fuel pump of a representative embodiment of the present teachings.

Fuel pump 10 according to a representative embodiment of the present teachings will be described. FIG. 1 shows a longitudinal sectional view of fuel pump 10. Fuel pump 10 may be used in a motor vehicle, fuel pump 10 being utilized within a fuel tank and being utilized for supplying fuel to an engine of the motor vehicle. As shown in FIG. 1, fuel pump 10 may comprise motor section 70 and pump section 12.

Motor section 70 comprises housing 72, motor cover 73, magnets 74, 75, and rotor 76. Housing 72 has a substantially cylindrical form. Motor cover 73 is attached to an upper end 72*a* of housing 72 by caulking (mechanically deforming) the upper end 72*a* of housing 72. Discharge port 73*a* is formed in motor cover 73 with an opening facing upwards. Magnets 74, 75 are fastened to the inside wall of housing 72. Rotor 76 has a main body 77 and a shaft 78 which vertically passes through the main body 77. The main body 77 comprises a core 79 which is fixed to the shaft 78, a coil (not shown) wound around the core 79, and a plastic part 80 which fills in around the coil. Commutator 84 is established at the top end of the main body 77. Brush 90 is in contact with the top edge surface of commutator 84. Brush 90 is pressed down by spring 92 which is fastened on one end to motor cover 73. When brush 90 becomes wore, brush 90 will move downward depending on the degree of wear, so that the contact between brush 90 and commutator 84 will be maintained. The top end 78*a* of shaft 78 is rotatably supported on motor cover 73 via a bearing 81. The bottom end 78*b* of shaft 78 is rotatably supported, via a bearing 82, on pump cover 14 of pump section 12.

Figure 2:
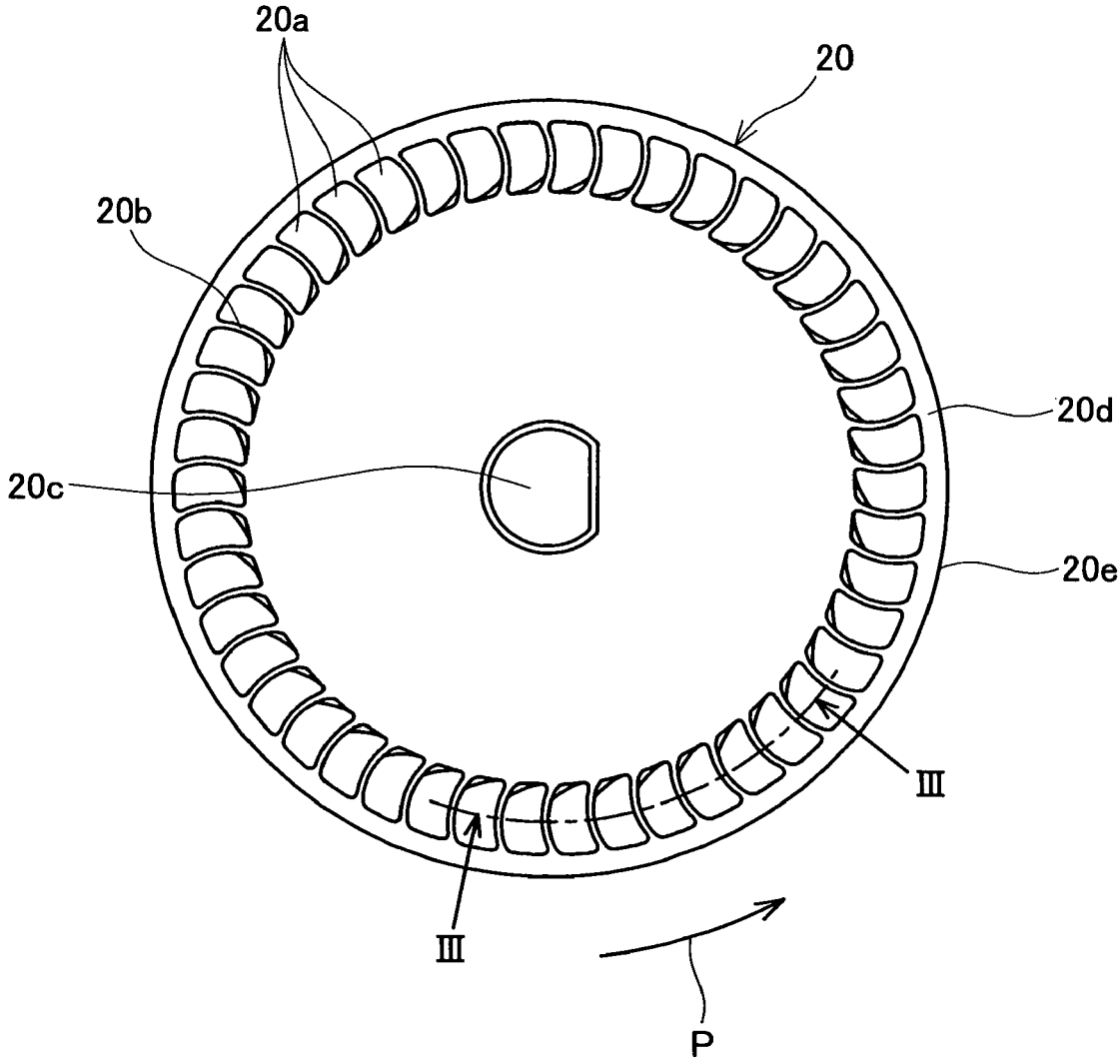
FIG. 2 is a plan view of an impeller.

Pump section 12 comprises casing 18 and impeller 20. FIG. 2 shows a plan view of impeller 20. As shown in FIG. 2, impeller 20 is a substantially disc shaped. A group of concavities 20*a* is formed in an upper face of impeller 20 in an area located inwardly from an impeller outer circumference face 20*e* by a predetermined distance. Adjacent concavities 20*a* are separated by a partitioning wall 20*b* that extends in the radial direction. The concavities 20*a* are repeated in the circumference direction of impeller 20. The group of concavities 20*a* extends along the circumference direction of impeller 20. An approximately D-shaped fitting hole 20*c* is formed in the center of impeller 20. A lower end of shaft 78 fits into the fitting hole 20*c*. By this means, impeller 20 is connected with shaft 78 in a manner allowing follow-up rotation whereby slight movement in the axial direction is allowed. The outer circumference face 20*e* of impeller 20 is a complete circular face without irregularities.

Figure 3:
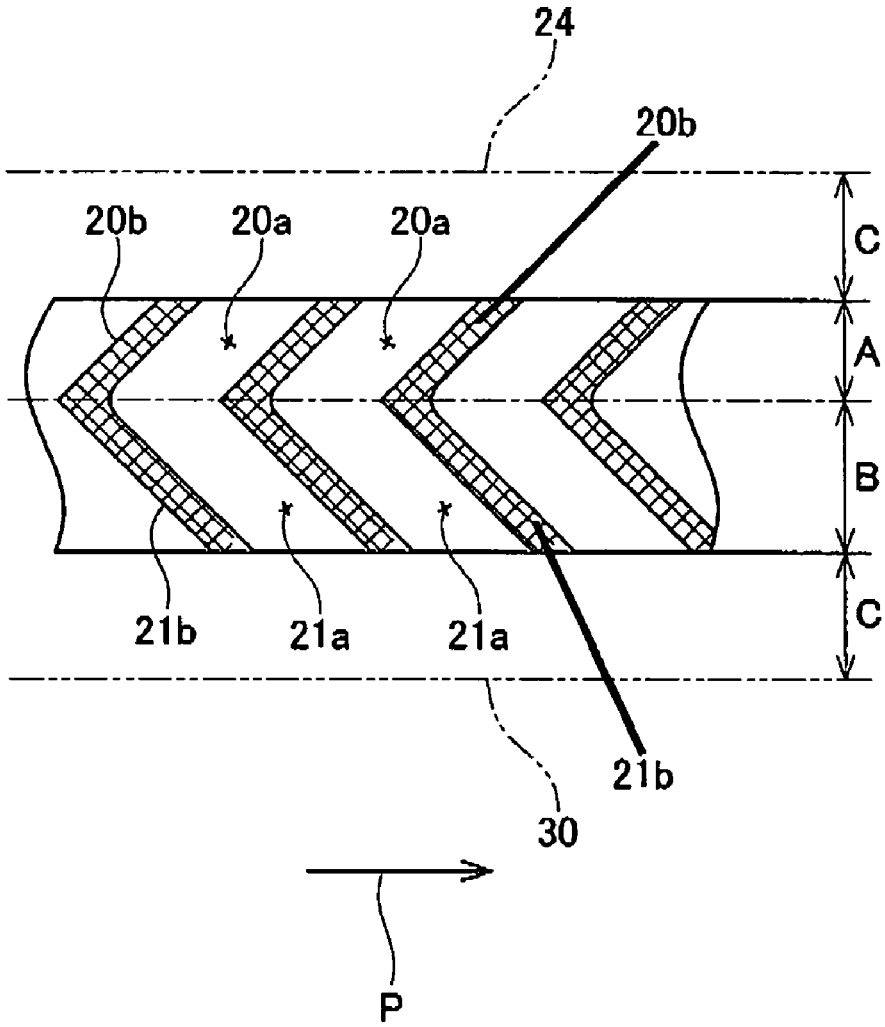
FIG. 3 is a cross-sectional view along line III-III of FIG. 2.

FIG. 3 is a cross-section drawing along curve III-III of FIG. 2. As shown in FIG. 3, a group of concavities 21*a* is formed in a lower face of impeller 20. The group of lower concavities 21*a* has the same configuration as of the group of upper concavities 20*a*. Bottom portions of the pair of upper concavities 20*a* and lower concavities 21*a* communicate together. The top edge of partitioning wall 21*b* is connected to the bottom edge of partitioning wall 20*b*. The partitioning walls 20*b* are angled to rise from the bottom edge to the top edge (i.e., upper face of impeller 20) in the direction that impeller 20 rotates (direction of arrow P in FIG. 2, 3). On the other hand, the partitioning walls 21*b* are angled down from the top edge to the bottom edge (i.e., lower face of impeller 20) in the direction that impeller 20 rotates. Therefore, an approximately V-shaped walls are formed by the partitioning walls 20*b* and partitioning walls 21*b*. The angle of inclination of the partitioning walls 20*b*, 21*b* is preferably adjusted within the range of 40~60° with regards to the rotating axis of impeller 20.

As is clear from FIG. 3, the partitioning walls 20*b* and the partitioning walls 21*b* are attached at a position which is to the upper face side of the center of impeller 20. Therefore, the concavity depth (B in the drawing) of the concavities 21*a* which are formed on the lower face of impeller 20 is deeper than the concavity depth (A in the drawing) of the concavities 20*a* which are formed on the upper face of impeller 20 (i.e., B>A). The ratio of B to A (B/A) is preferably adjusted to be between 1.02 and 1.30.

Casing 18 comprises pump cover 14 and pump body 16. As shown in FIG. 1, pump cover 14 has a recessed region 14*a* in the impeller side surface (i.e., the bottom side surface in FIG. 1). The diameter of the recessed region 14*a* is nearly the same as the diameter of impeller 20. The recessed region 14*a* has a depth which is nearly as large as the thickness of impeller 20. Impeller 20 is rotatably fitted into this recessed region 14*a*.

Casing 18 (comprising pump cover 14 and pump body 16) is attached to lower end 72*b* of housing 72 by caulking (mechanically deforming) the lower end 72*b* of housing 72 with impeller 20 disposed within the recessed region 14*a* of pump cover 14. The bottom edge 78*b* of shaft 78 is inserted into the fitting hole 20*c* of impeller 20 at a position which is lower than the position supported by the bearing 82. Therefore, when rotor 76 rotates, impeller 20 will also rotate in conjunction. A thrust bearing 33 which receives the thrust load of shaft 78 is disposed between the bottom end of shaft 78 and pump body 16.

Figure 4:
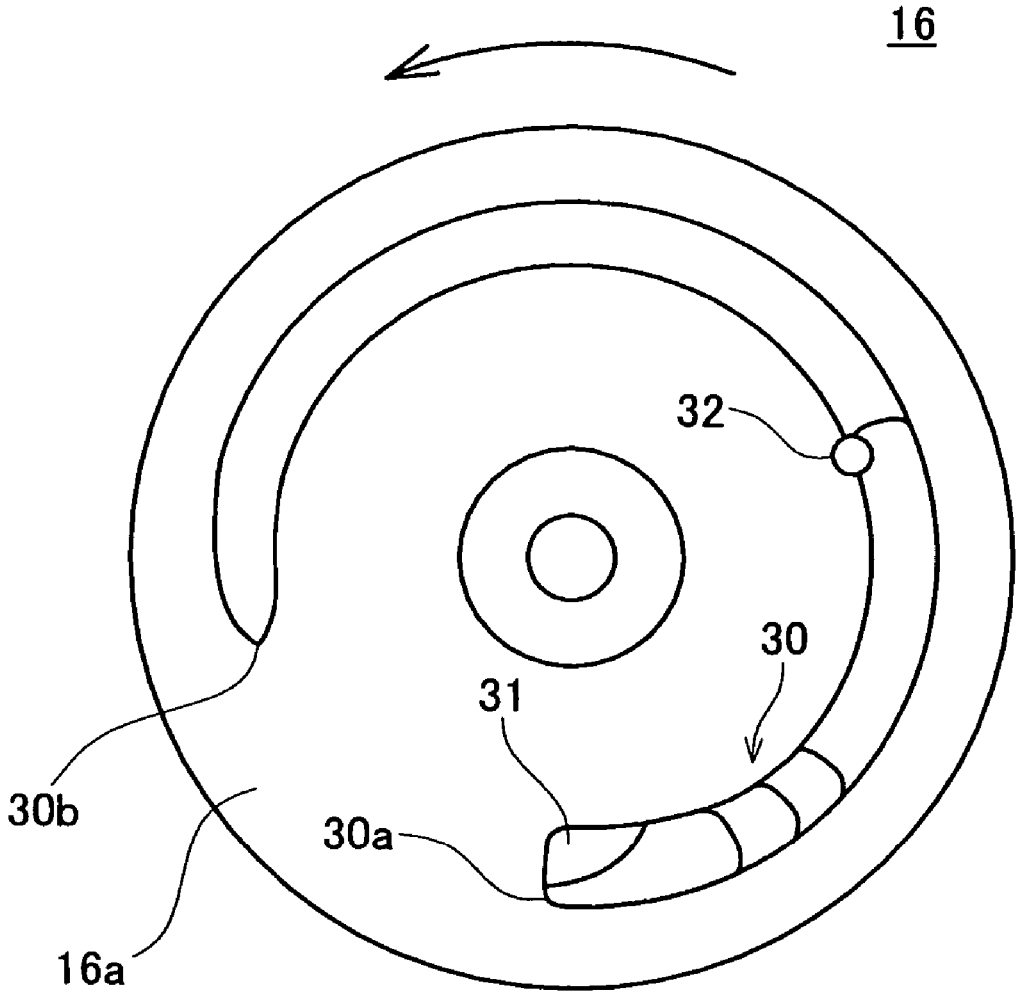
FIG. 4 is a top plan view of a pump body.

FIG. 4 shows a plan view of pump body 16 viewed from the impeller side (or in other words viewed from the top side in FIG. 1). As shown in FIGS. 1 and 4, groove 30 is formed in an upper face of pump body 16 in an area directly facing the group of concavities 21*a* in the lower face of impeller 20. Groove 30 extends continuously along the rotational direction of impeller 20 from an upstream end 30*a* to a downstream end 30*b*. An opening of a vapor jet 32, which penetrates vertically through pump body 16, is formed adjacent to groove 30.

Groove 30 is formed with a nearly consistent depth (depth shown by C in FIG. 3) from the vapor jet 32 to the downstream end 30*b*. Groove 30 gradually deepens from the vapor jet 32 toward the upstream side. Groove 30 is connected to suction hole 31 in the region close to the upstream end 30*a*. As shown in FIG. 1, suction hole 31 continues from groove 30 to the lower surface of pump body 16. Suction hole 31 passes through casing 18 from the exterior to the interior of casing 18.

Figure 5:
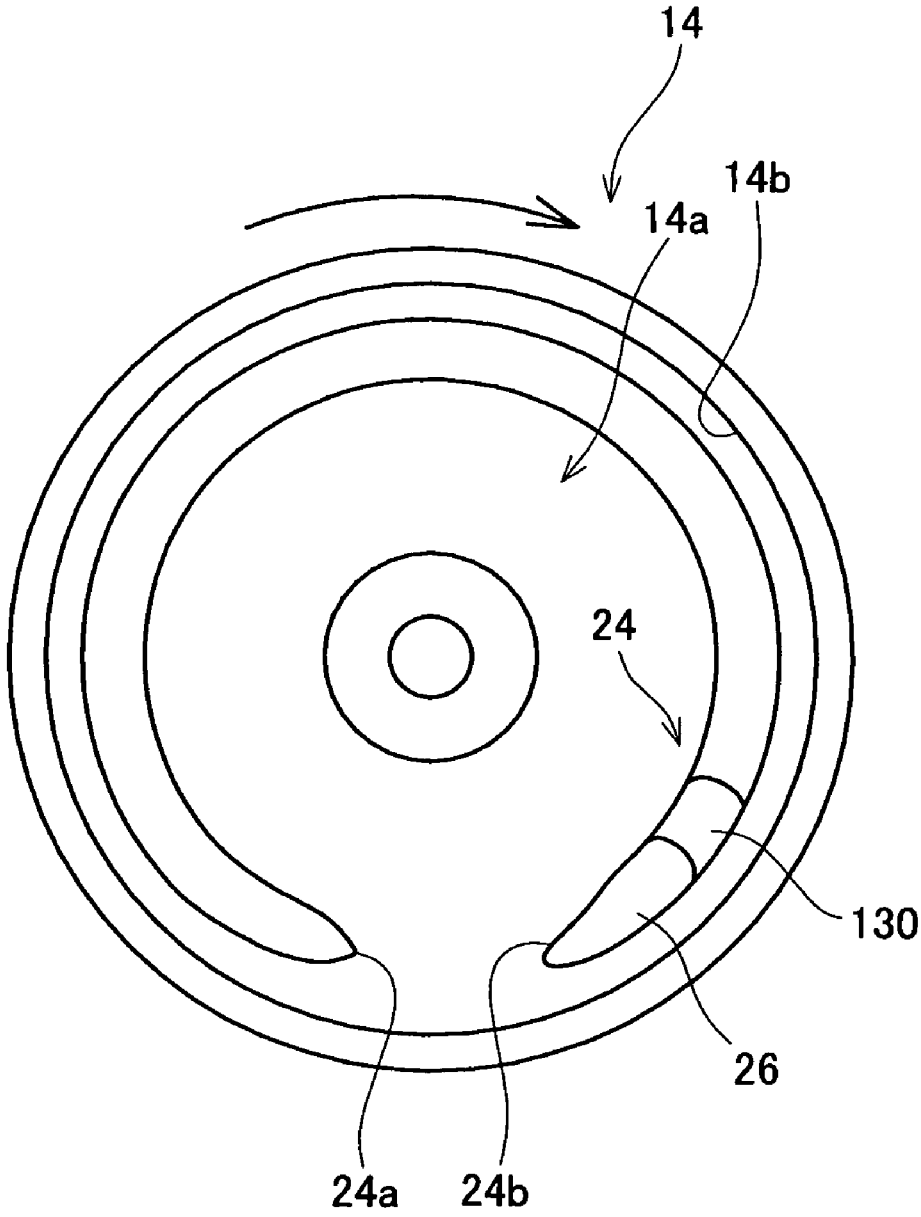
FIG. 5 is a top plan view of a pump cover.

FIG. 5 shows a plan view of pump cover 14 as viewed from the impeller side (or in other words, as viewed from the bottom side in FIG. 1). In FIG. 5, the direction of rotation of impeller 20 is shown in the reverse direction as that of FIG. 4. Groove 24 is formed in the bottom surface of the recessed region 14*a* of pump cover 14. Groove 24 is formed in an area directly facing the group of the concavities 20*a* in the upper face of impeller 20 which is inserted into the recessed region 14*a*.

Groove 24 extends continuously in the rotational direction of impeller 20 from an upstream end 24*a* to a downstream end 24*b*. Groove 24 is connected to a discharge hole 26 in the region around the downstream end 24*b*. Discharge hole 26 continues from groove 24 to the upper surface of pump cover 14. Discharge hole 26 passes through casing 18 from the exterior to the interior of casing 18.

Groove 24 is formed with a nearly consistent depth between the upstream end 24*a* and a region 130, and the depth is nearly the same as the groove depth of the lower side groove 30 (Specifically, groove depth between the vapor jet 32 and the downstream end 30*b*) (Refer to FIG. 3). The depth of groove 24 gradually becomes deeper toward the downstream from the region 130. The downstream end of region 130 is connected to discharge hole 26. The region 130 is provided so that fuel will be smoothly introduced into discharge hole 26.

Note, a small clearance is formed between the outer surface 20*e* of impeller 20 and the circumference surface 14*b* of the recessed region 14*a* of pump cover 14. This clearance is provided for impeller 20 to rotate smoothly.

In the above fuel pump 10, swirl flow is generated between the concavities 21*a* on the lower side of impeller 20 and the intake side groove 30 of pump body 16 when impeller 20 rotates. Specifically, swirl flow is created in the concavities 21*a* and the intake side groove 30 when the fuel in the concavities 21*a* and the intake side groove 30 flows to the inward side of the concavities 21*a* from the intake side groove 30, flows along the concavities 21*a* from the inward side to the outward side through the concavities 21*a*, and then returns from the outward side of the concavities 21*a* to the intake side groove 30. The partitioning wall 21*b* of impeller 20 are at an angle with regards to the rotating axis of impeller 20, so the fuel will flow smoothly from the intake side groove 30 to the concavities 21*a*, and the fuel will be smoothly discharged from the concavities 21*a* to the intake side groove 30.

The fuel is pressurized along the intake side groove 30 while revolving as described above. As fuel is pressurized along the intake side groove 30, fuel is drawn in through the suction hole 31 of pump body 16. The fuel which was pressurized in the intake side groove 30 mixes with the fuel remaining in the concavities 20*a* on the upper side of impeller 20. The fuel in the casing 18 is also pressurized along the discharge side groove 24.

Swirl flow is also generated along the concavities 20*a* on the upper side of impeller 20 and the discharge side groove 24. Specifically, swirl flow is created in the concavities 20*a* and the discharge side groove 24 when the fuel in the concavities 20*a* and the discharge side groove 24 enters the inward side of the concavities 20*a* from the discharge side groove 24, flows along the concavities 20*a* from the inward side to the outward side through the concavities 20*a*, and then returns from the outward side of the concavities 20*a* to the discharge side groove 24 in the region without discharge hole 26. At this time, the partitioning wall 20*b* of impeller 20 are at an angle with regards to the rotating axis of impeller 20, so fuel will flow smoothly from the discharge side groove 24 to the concavities 20*a*, and the fuel will be smoothly discharged from the concavities 20*a* to the discharge side groove 24. On the other hand, in the region of discharge hole 26, the fuel which is discharged from the outward side of the concavities 20*a* will flow in the direction of discharge along discharge hole 26.

The fuel, which is discharged to discharge hole 26, flows into housing 72 of motor section 70. The fuel, which flows into the housing 72, then flows upward through housing 72 and is discharged from discharge port 73*a* of motor cover 73.

The fuel pressure on the fuel discharge side of impeller 20 will be higher than the fuel pressure on the fuel intake side, so a downward force caused by the difference in fuel pressure will act on impeller 20. Furthermore, a downward force will act on impeller 20 because of the downward magnetic force acting on rotor 76 and the force applied on brush 90 toward commutator 84 by spring 92.

Fuel pump 10 of this representative embodiment is formed such that the depth of the concavities 21*a* on the fuel intake side of impeller 20 is relatively deeper than the concavities 20*a* on the fuel discharge side of impeller 20. Therefore, the force (upward force in FIG. 1) acting on impeller 20 and caused by the swirl flow along the intake side groove 30 and the concavities 21*a* on the fuel intake side of impeller 20 will be larger than the forces (downward force in FIG. 1) acting on impeller 20 and caused by the swirl flow along the discharge side groove 24 and the concavities 20*a* on the fuel discharge side of impeller 20. Therefore, the aforementioned forces pressing downward on impeller 20 will be balanced with the forces pressing upward on impeller 20, and impeller 20 will be stable and able to smoothly rotate. Therefore, the flow properties of fuel pump 10 will be stable and pulsing can be prevented.

Figure 6:
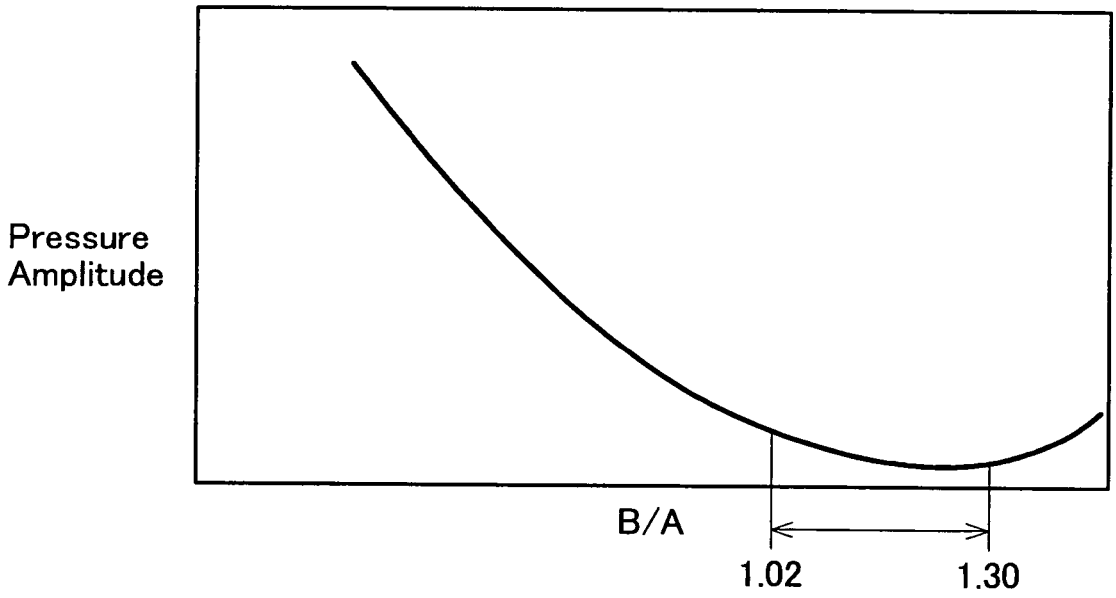
FIG. 6 is a graph showing changes in fuel pressure amplitude (pulse amplitude) by a ratio (groove depth B of concavities on the fuel intake side of the impeller)/(groove depth A of concavities on the fuel discharge side of the impeller).

FIG. 6 shows the measurement result of the pressure amplitude for fuel which is discharged from fuel pump 10 when a ratio (groove depth B of the concavities 21*a* on the fuel intake side of impeller 20)/(groove depth A of the concavities 20*a* on the fuel discharge side of impeller 20) is gradually changed. Note, the measurements were taken when the impeller rotational speed was relatively low (specifically between 3000 and 3500 rpm) and the discharge pressure of the fuel was relatively high (specifically between 250 and 350 kPa). As can be seen from FIG. 6, the fuel pressure amplitude (pulse amplitude) can be suppressed by maintaining the value B/A to be greater than 1.0. In particular, it has been confirmed that the pulsing flow of the fuel can effectively be suppressed by maintaining B/A between 1.02 and 1.30.

The preferred representative embodiment of the present teachings have been described above, the explanation was given using, as an example, the present teachings is not limited to this type of configuration.

Figure 7:
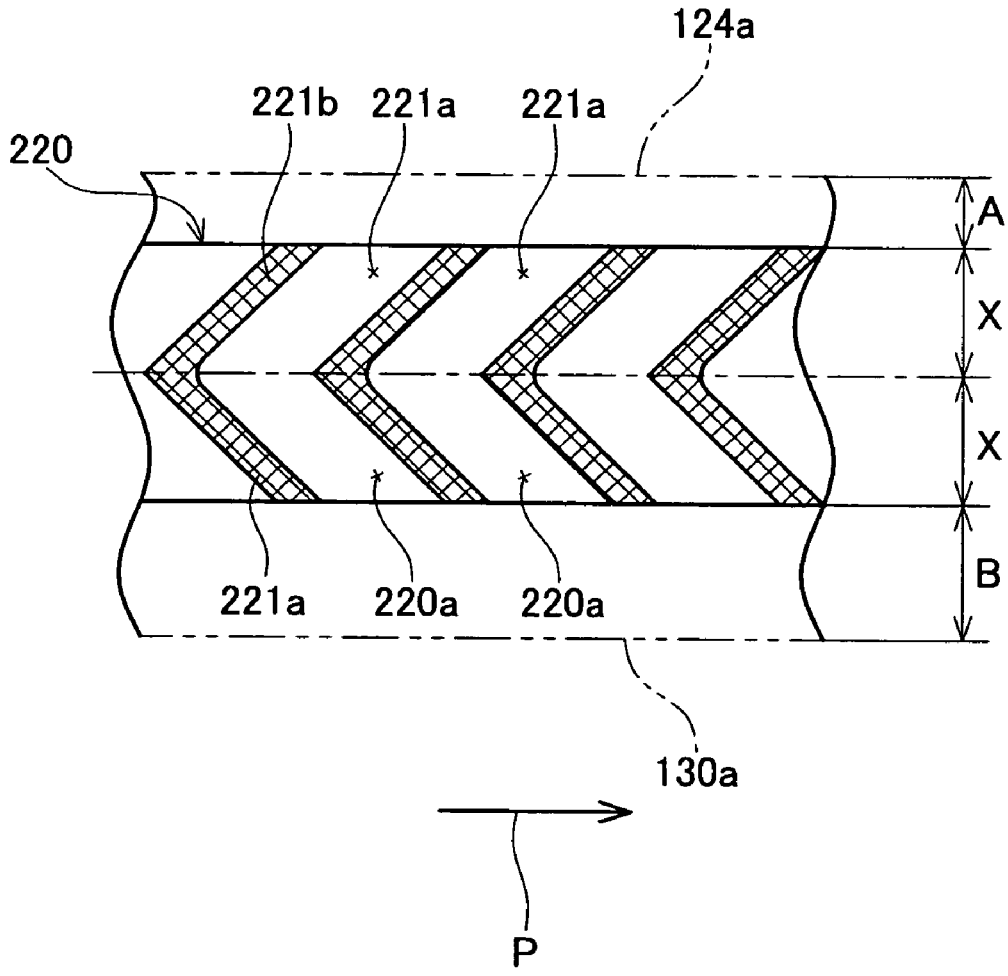
FIG. 7 is a drawing showing another representative embodiment of the present teachings.

For instance, in the above embodiment, the depth of the concavities on the fuel intake side of the impeller is deeper than the depth of the concavities on the fuel discharge side of the impeller. However, the present teachings is not restricted to this configuration, and for instance, an embodiment shown in FIG. 7 is also possible. With the embodiment shown in FIG. 7, the depth of the concavities 220*a*, 221*a* formed on the upper and lower side of impeller 220 are the same (X in the drawing). Furthermore, the intake side groove 130*a* (groove depth B) formed on a pump body is deeper than the discharge side groove 124*a* (groove depth A) formed on pump cover (i.e., B>A). With this type of structure as well, the flow of fuel which revolves on the fuel intake side of impeller 220 will be higher than the flow of fuel which revolves on the fuel discharge side, and therefore the flow properties of the fuel pump can be improved. In this case, the ratio of (groove depth B of groove 130*a*)/(groove depth A of groove 124*a*) is preferably adjusted to be between 1.02 and 1.30. If the ratio of B/A is below 1.00, the upward pressing force created by the swirl flow below the impeller will be smaller than the downward pressing force created by the swirl flow above the impeller, and the impeller 220 is pressed downward. Furthermore, if the value B/A is between 1.00 and 1.02, the sum of the fuel pressure and the downward pressing force created by the swirl flow above the impeller will be larger than the upward pressing force created by the swirl flow below the impeller, so the impeller 220 will be pressed downward. Furthermore, if B/A exceeds 1.30, the upward force created by the swirl flow below the impeller will be greater than the sum of the fuel pressure and the downward pressing force created by the swirl flow above the impeller, and therefore the balance will be poor.

Furthermore, the depth of the concavities on the fuel intake side of the impeller may be deeper than the depth of the concavities on the fuel discharge side of the impeller, and the intake side groove formed on a pump body may be deeper than the discharge side groove formed on pump cover.

Furthermore, both the groove depths of the concavities formed on the upper and lower surfaces of the impeller and the depths of the casing grooves which are formed on the inside surface of the casing opposite to the upper and lower surfaces of the impeller may be nonsymmetric.

Furthermore, the technology of the present teachings can be applied to various types of fuel pumps other than the type of fuel pump described in the representative embodiment, and for instance, may also be applied to an axial type fuel pump.

Finally, although the preferred representative embodiments have been described in detail, the present embodiments are for illustrative purpose only and not restrictive. It is to be understood that various changes and modifications may be made without departing from the spirit or scope of the appended claims. In addition, the additional features and aspects disclosed herein also may be utilized singularly or in combination with the above aspects and features.

The invention claimed is:

1. A fuel pump comprising a casing and a substantially disc-shaped impeller rotating within the casing, wherein;

a first group of concavities is formed in a lower face of the impeller, the first group of concavities being formed in an area located inwardly from the outer circumferential face of the impeller by a predetermined distance;

a second group of concavities is formed in an upper face of the impeller, the second group of concavities being formed in an area located inwardly from the outer circumferential face of the impeller by a predetermined distance, bottom portions of the pair of first and second concavities being in communication with each other;

a first groove is formed in the inner face of the casing opposite the lower face of the impeller, the first groove being formed in a region opposite the first group of concavities in the impeller and extending from an upstream end to a downstream end;

a second groove is formed in the inner face of the casing opposite the upper face of the impeller, the second groove being formed in a region opposite the second group of concavities in the impeller and extending from an upstream end to a downstream end;

a suction hole is formed passing through the casing for communicating the upstream end of the first groove to the exterior of the casing, the suction hole being connected to the upstream end of the first groove and not in connection with the second groove;

a discharge hole is formed passing through the casing for communicating the downstream end of the second groove to the exterior of the casing, the discharge hole being connected to the downstream end of the second groove and not in connection to the first groove; and wherein, the depth of the first group of concavities and the depth of the second group of concavities are substantially identical, and the depth of the first groove is deeper that the depth of the second groove.

2. A fuel pump as in claim 1, wherein the depth of the first groove is between 1.02 and 1.30 times the depth of the second groove.

3. A fuel pump comprising a casing and a substantially disc-shaped impeller rotating within the casing, wherein;

a first group of concavities is formed in a lower face of the impeller, the first group of concavities being formed in an area located inwardly from the outer circumferential face of the impeller by a predetermined distance;

a second group of concavities is formed in an upper face of the impeller, the second group of concavities being formed in an area located inwardly from the outer circumferential face of the impeller by a predetermined distance, bottom portions of the pair of first and second concavities being in communication with each other;

a first groove is formed in the inner face of the casing opposite the lower face of the impeller, the first groove being formed in a region opposite the first group of concavities in the impeller and extending from an upstream end to a downstream end;

a second groove is formed in the inner face of the casing opposite the upper face of the impeller, the second groove being formed in a region opposite the second group of concavities in the impeller and extending from an upstream end to a downstream end;

a suction hole is formed passing through the casing for communicating the upstream end of the first groove to the exterior of the casing, the suction hole being connected to the upstream end of the first groove and not in connection with the second groove;

a discharge hole is formed passing through the casing for communicating the downstream end of the second groove to the exterior of the casing, the discharge hole being connected to the downstream end of the second groove and not in connection to the first groove; and wherein, the depth of the first groove and the depth of the second groove are substantially identical and the depth of the first group of concavities is deeper than the depth of the second group of concavities.

4. A fuel pump as in claim 3, wherein the depth of the first group of concavities is between 1.02 and 1.30 times the depth of the second group of concavities.

5. A fuel pump comprising a casing and a substantially disc-shaped impeller rotating within the casing, wherein;

a first group of concavities is formed in a lower face of the impeller, the first group of concavities being formed in an area located inwardly from the outer circumferential face of the impeller by a predetermined distance;

a second group of concavities is formed in an upper face of the impeller, the second group of concavities being formed in an area located inwardly from the outer circumferential face of the impeller by a predetermined distance, bottom portions of the pair of first and second concavities being in communication with each other;

a first groove is formed in the inner face of the casing opposite the lower face of the impeller, the first groove being formed in a region opposite the first group of concavities in the impeller and extending from an upstream end to a downstream end;

a discharge hole is formed passing through the casing for communicating the downstream end of the second groove to the exterior of the casing, the discharge hole being connected to the downstream end of the second groove and not in connection to the first groove; and wherein, a second groove is formed in the inner face of the casing opposite the upper face of the impeller, the second groove being formed in a region opposite the second group of concavities in the impeller and extending from an upstream end to a downstream end;

a suction hole is formed passing through the casing for communicating the upstream end of the first groove to the exterior of the casing, the suction hole being connected to the upstream end of the first groove and not in connection with the second groove;

the depth of the first and second groups of concavities and the depths of the first and second grooves are formed so that the flow of fuel passing through the first group of concavities and the first groove is greater than the flow of fuel passing through the second group of concavities and the second groove.

6. A fuel pump as in claim 5, wherein the depth of the first group of concavities and the depth of the second group of concavities are substantially identical and the depth of the first groove is deeper than the depth of the second groove.

7. A fuel pump as in claim 5, wherein the depth of the first groove and the depth of the second groove are substantially identical, and the depth of the first group of concavities is greater than the depth of the second group of concavities.

8. A fuel pump as in claim 5, wherein the depth of the first groove is greater than the depth of the second groove, and the depth of the first group of concavities is greater than the depth of the second group of concavities.

* * * * *